United States Patent [19]

Armstrong

[11] 4,081,932

[45] Apr. 4, 1978

[54] PLATFORM CRANE

[75] Inventor: James Eubank Armstrong, Crosby, Tex.

[73] Assignee: Pool Company, Dallas, Tex.

[21] Appl. No.: 698,119

[22] Filed: Jun. 21, 1976

Related U.S. Application Data

[63] Continuation of Ser. No. 603,734, Aug. 11, 1975, abandoned, which is a continuation of Ser. No. 488,276, Jul. 15, 1974, abandoned.

[51] Int. Cl.[2] ..... E02B 17/00

[52] U.S. Cl. ..... 52/111; 61/87; 173/28; 175/9

[58] Field of Search ..... 52/111, 114, 116, 118, 52/645, 646; 61/46, 46.5; 173/28, 1; 175/5-10

[56] References Cited

U.S. PATENT DOCUMENTS

| | | | |
|---|---|---|---|
| 3,244,242 | 5/1966 | Wolff | 61/46.5 X |
| 3,739,853 | 6/1973 | Wales | 52/116 X |
| 3,802,137 | 4/1974 | Armstrong | 52/118 |

*Primary Examiner*—J. Karl Bell

*Attorney, Agent, or Firm*—Ned L. Conley; Russell D. Weaver

[57] ABSTRACT

A mobile crane for use on an offshore oil well platform, comprising parallel base beams adapted to span the capping beams of the platform, and a pedestal and a rotating upper works movably mounted on the base beams. A method is described for erecting a workover rig on the offshore platform by means of the crane, and for expeditiously erecting workover rigs on a plurality of platforms in succession.

7 Claims, 3 Drawing Figures

44
30
36
42
38
40
40
38
43
43
43
24
45
18
20
32
34

PLATFORM CRANE

This is a continuation of application Ser. No. 603,734, filed on Aug. 11, 1975 now abandoned, which is a continuation of abandoned application Ser. No. 488,276, filed on July 15, 1974.

BACKGROUND OF THE INVENTION

1. Field of the Invention

This invention relates to mobile cranes for use on offshore oil well platforms, and to the utilization of such cranes in the erection of workover rigs on such platforms.

2. Description of the Prior Art

Offshore oil and gas wells are often completed at the dock of a platform which is supported above the water by means of a plurality of legs. Usually each platform will have a plurality of wells completed thereon, ranging from a few wells up to 40 or more. From time to time after the completion of a well, it is necessary to bring a workover rig to the platform to perform certain operations on the well. One form of workover rig suitable for this purpose is disclosed in applicant's U.S. Pat. No. 3,802,137, issued Apr. 9, 1974.

Such a workover rig is designed to rest on the capping beams of the platform which may be from 25 feet to 55 feet apart and which extend from one side of the platform to the other. Such beams are extremely heavy and strong, having sufficient strength to support the loads imposed by the workover Fig. The portion of the deck between the capping beams and extending outwardly therefrom usually has insufficient strength to support such loads. In addition, those outwardly extending portions of the deck usually have mounted thereon various tanks, pumps and other production equipment which may be necessary in connection with the production of oil or gas from the well and for the transporting of the oil or gas from the well to the shore.

Such platforms also normally are equipped with a small affixed crane which is positioned for on loading and off loading of equipment. However, such platform cranes have been inadequate for placing a workover rig on the platform, since the platform crane is in a fixed position and has insufficient capacity at a long enough distance to allow it to place the workover rig in position for operating on all of the wells of the platform. Thus, it has heretofore been necessary to use a derrick barge to erect the workover rig on the platform and to remove it from the platform after the work on each platform is completed. Since derrick barges are quite expensive, it often cost from $60,000 to $200,000 just to move a rig from one platform to another. Then when the rig's work on that platform was finished, it was necessary to bring the derrick barge back to remove the rig from that platform and move it to and erect it on another platform.

SUMMARY OF THE INVENTION

According to the present invention a workover rig is erected on and removed from a platform by means of a mobile platform crane having a pedestal which is supported on a pair of base beams which span the existing capping beams of the platform. The permanent fixed deck crane may be used to lift the elements of the mobile crane onto the platform. and the mobile crane may then be used to erect and to dismantle the workover rig, thereby eliminating the necessity of a derrick barge.

Since all the load can be supported directly on the existing capping beams, no modification of the structure of the platform is required.

In one embodiment of the invention substantial time is saved in doing workover operations on a plurality of platforms by utilizing a pair of mobile cranes and a single workover rig. In this operation a crane is erected on a second platform while workover operations are being performed on a first platform, and then the workover rig is transferred to the second platform where it performs operations while the crane from the first platform is moved to a third platform. This results in a saving of a day or more of rig time on each platform.

DESCRIPTION OF THE PREFERRED EMBODIMENTS

Figure 2:
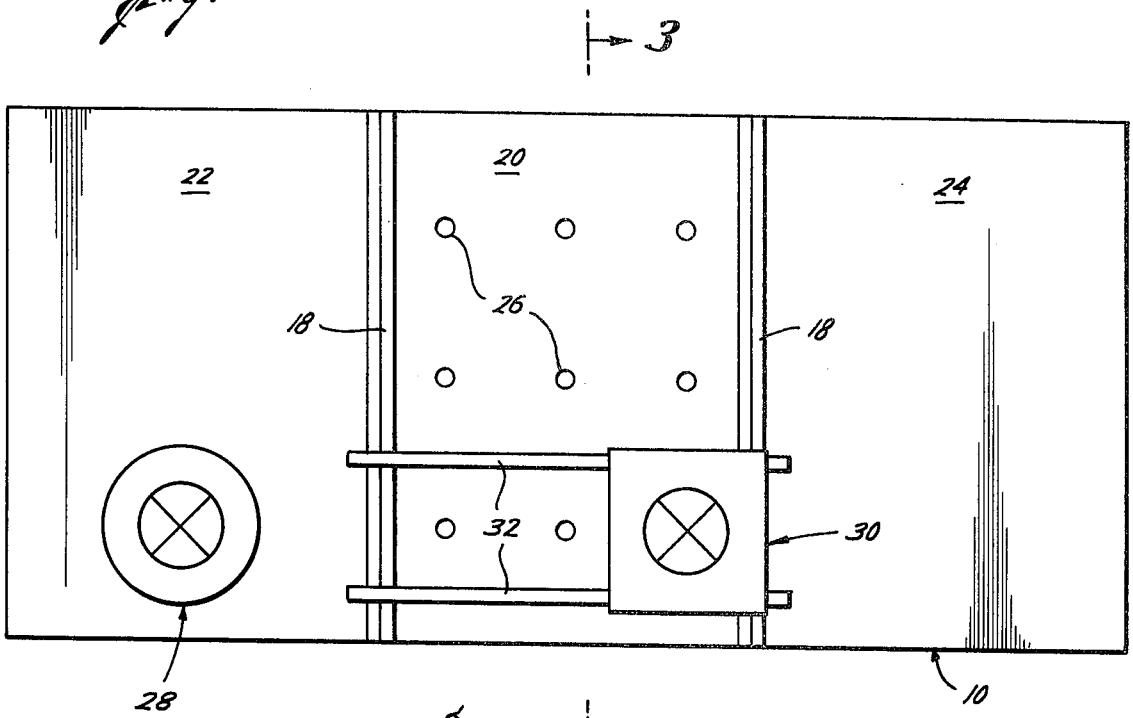
FIG. 2 shows a plan view of an offshore platform having a crane according to this invention mounted thereon.
Figure 3:
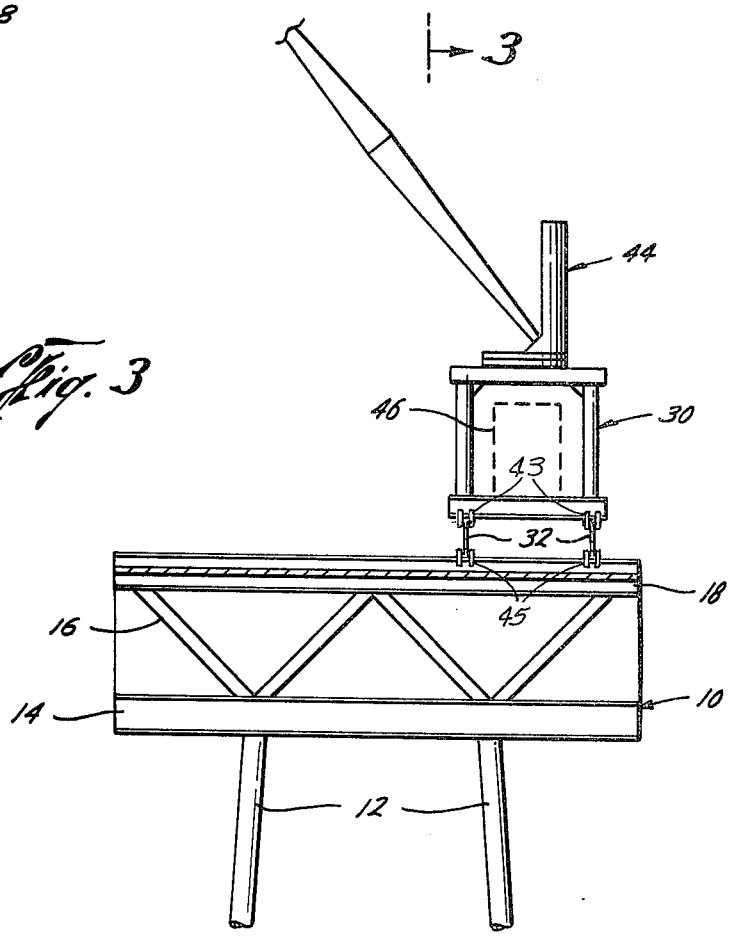
FIG. 3 is a vertical sectional view of the embodiment shown in FIG. 2, taken at line 3—3 of FIG. 2.

FIGS. 2 and 3 illustrate a typical offshore platform 10 supported on a plurality of platform legs 12 which are surmounted by horizontal beams 14. A truss 16 supports a pair of capping beams 18.

A production deck 20 extends between the capping beams and production equipment decks 22 and 24 extend outwardly of the capping beams for the support of various equipment (not shown) which is required for the handling of oil or gas produced from the wells identified at 26, nine such wells being shown in the drawing.

A fixed platform crane is schematically identified at 28, mounted on the equipment deck 22, and a mobile crane according to one embodiment of this invention is schematically identified at 30. The mobile crane 30 is mounted on a pair of base beams 32 which span the production deck 20 and rest upon the capping beams 18.

Figure 1:
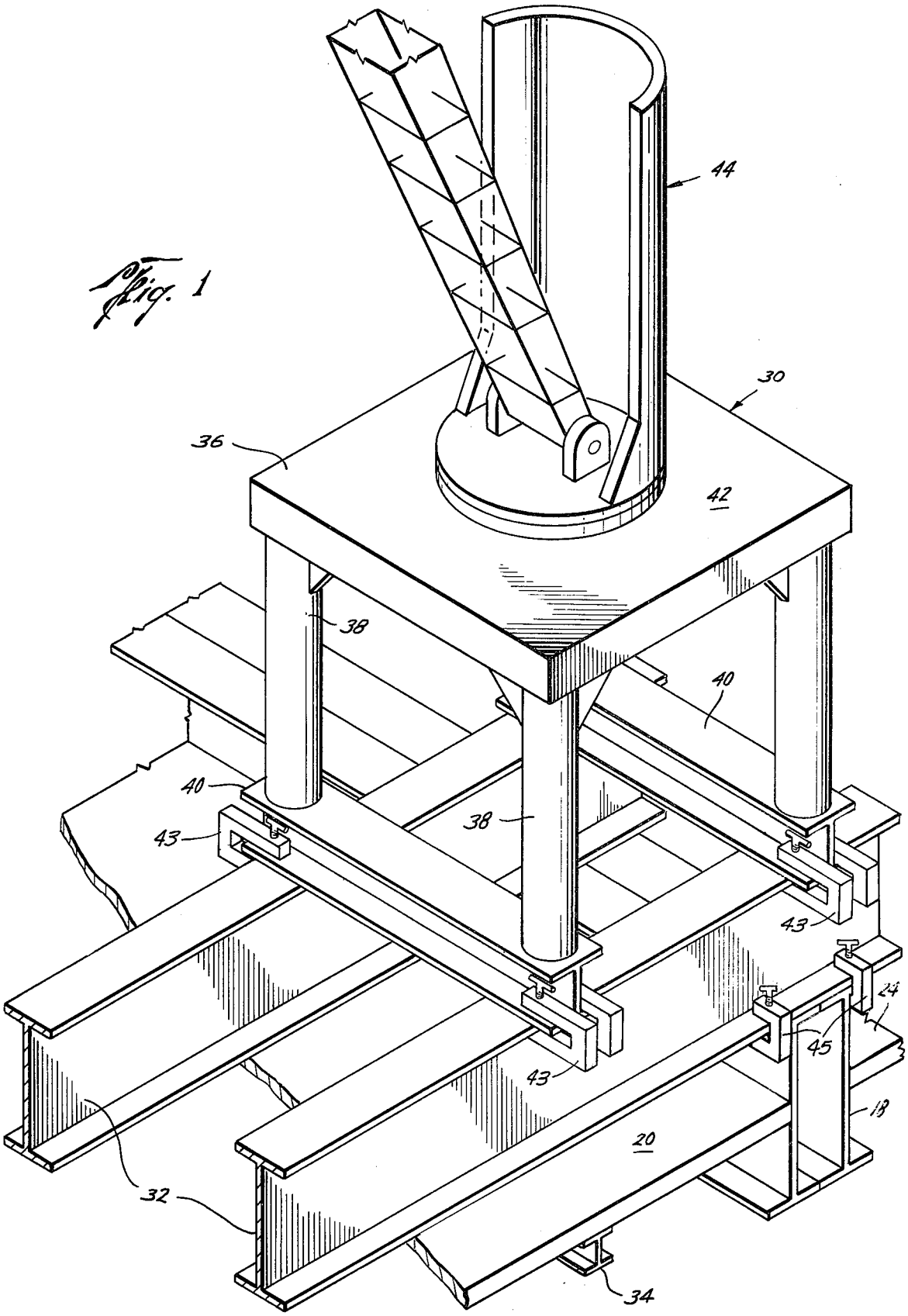
FIG. 1 shows a somewhat fragmented isometric view of one embodiment of the mobile crane of this invention.

This structure is illustrated more clearly in FIG. 1 wherein the capping beam 18 is shown to be constructed, in this embodiment, from a pair of I-beams, and the decks 20 and 24 are shown to be supported on smaller wide flange beams such as the beam 34. The capping beams are very heavy, strong beams designed to support tremendous weights, as for example the weight of a drilling rig or a workover rig. The decks, however, will support only relatively small loads, and will not support a workover rig.

A pedestal 36, comprising four legs 38 mounted on a pair of beams 40 and supporting a rotary base 42, is mounted on top of the base beams 32. The beams 40 may be bolted, clamped or otherwise removably attached to the base beams 32, and the base beams may similarly be removably attached to the capping beams 18. In FIGS. 1 and 3 C-clamps 43 are used for attaching the beams 40 to the base beams 32, and C-clamps 45 are used for attaching the base beams 32 to the capping beams 18.

The rotating upper works 44 of the crane are illustrated only schematically, since any suitable design may be used, and the design of such upper works does not form a part of this invention. FIG. 3 shows in broken lines a possible position for a power unit 46 for the crane.

The crane is thus readily broken down into a number of relatively small portions which can be easily lifted to and from the platform by means of the fixed crane 28. Accordingly, this crane can be used to make separate lifts of each of beams 32, the pedestal 30, the power unit 46, and the rotating upper works 44. The rotating upper works may, if necessary, be broken down into smaller units. Thus, the entire mobile crane can be erected on the platform by means of the fixed crane 28. The mobile crane, once erected, may be used to unload the workover rig from a vessel, such as a ship or barge, and erect the rig on the platform. Since the crane rests on the capping beams of the platform, it is able to support heavy loads, and it can be placed close to the wells so that the workover rig can be placed where desired. Thus, it is no longer necessary to have a derrick barge available for the erection of the workover rig. Instead of the usual $60,000 to $200,000 cost of moving a rig from one platform to another, by the use of this invention the cost may be reduced to as little as $15,000.

It is apparent that because of the mobility of the crane 30, it can readily be placed in any desired position along the length of the base beams 32, and the base beams 32 may be placed at any desired location along the length of the capping beams 18. Thus, this crane may be positioned so that it can make lifts from a vessel floating alongside the platform and place equipment at any desired location between the capping beams. A workover rig can therefore be placed directly over any one of the wells 26. Furthermore, the crane can be skidded along the base beams 32 and the base beams 32 can be skidded along the capping beams 18 as necessary to position the crane at any desired location over the production deck. Such skidding may be accomplished by means of a snatch block or with hydraulic jacks or any other convenient equipment. Usually the crane will not have to be moved more than once on each platform.

The apparatus of this invention is particularly useful and results in outstanding savings when workovers are to be done on a number of platforms. Under this circumstance, preferably two of the mobile cranes 30 and one workover rig are carried on the vessel which transports equipment to the platforms. A first mobile crane is erected on the first platform and this crane is used to erect the workover rig on that platform. While workover operations are being performed on the first platform, the vessel is moved to the second platform where a second crane is erected. The vessel then returns to the first platform and recovers the workover rig and mobile crane from this platform. The workover rig is then transported to the second platform and erected thereon by means of the mobile crane 30 which has previously been erected on this platform. The mobile crane which has been removed from the first platform is then carried to a third platform and erected there while workover operations are being carried out on the second platform. This "leap frog" process is repeated until the workovers are complete on all of the platforms.

The advantage of this type of operation is that the amount of time required for the erection of a workover rig is substantially reduced, since the crane equipment for such erection is already in place when the rig arrives at the platform. This results in substantial savings in the cost of workover operations since a day or more of rig time is saved on each platform. By merely adding a relatively low cost crane to the equipment, and using this "leap frog system", the total time required for workover operations is substantially reduced, and the cost of workover operations is reduced by $4,000.00 or more per platform.

Many modifications and variations of the apparatus, methods and systems disclosed will be apparent to those skilled in the art upon consideration of the foregoing. Accordingly, the invention is not to be considered to be limited to the specific embodiments disclosed, but to all forms which may come within the scope of the appended claims.

I claim:

1. A method for constructing a rig on an offshore platform having a pair of substantially parallel horizontal capping beams and a deck-mounted crane comprising lifting a pair of base beams with said deck-mounted crane and placing them to span said capping beams, removably attaching said base beams to said capping beams, lifting a pedestal of a second crane with said deck-mounted crane and placing it on said base beams, removably attaching said crane pedestal to said base beams, lifting a second crane rotating upper works with said deck-mounted crane and placing said works on the pedestal, fastening said works to said pedestal, and lifting elements of such a rig with said second crane and placing them on said capping beams.

2. A method as defined by claim 1 wherein both the second crane and the rig are lifted from a vessel alongside the platform.

3. A method as defined by claim 1 wherein the second crane is skidded along the base beams and then the base beams are skidded along the capping beams to a desired location.

4. A method of performing workover operations at a plurality of offshore platforms comprising erecting a first crane on a first platform, erecting a rig on the first platform by means of said first crane.

erecting a second crane on a second platform while operations are being performed by the rig on the first platform, removing the rig from the first platform by means of the first crane, removing the first crane from the first platform, and erecting the rig on the second platform by means of the second crane.

5. A method as defined by claim 4 and including erecting the first crane on a third platform while operations are being performed by the rig on the second platform.

6. A method of performing workover operations at a plurality of offshore platforms comprising carrying a workover rig and two portable cranes in a vessel, erecting the first portable crane on a first platform, erecting the rig on the first platform by means of the first portable crane, transporting the second portable crane on the vessel to a second platform and erecting the second portable crane on the second platform, performing workover operations on the first platform while the second portable crane is being erected, removing the workover rig from the first platform by means of the first portable crane and returning it to the vessel, removing the first portable crane from the first platform and returning it to the vessel, transporting the workover rig on the vessel to the second platform, erecting the rig on the second platform by means of the second portable crane, transporting the first portable crane to a third platform, erecting the first portable crane on the third platform, and performing workover operations on the second platform while the first portable crane is being erected on the third platform.

7. A method for constructing a portable mobile crane on an offshore platform having a fixed crane mounted thereon and a pair of substantially parallel horizontal capping beams comprising, lifting a pair of base beams from a transport vessel with said fixed crane, placing said base beams on said capping beams whereby the base beams span the capping beams, releasably attaching the base beams to the capping beams, lifting a crane pedestal from said transport vessel with said fixed crane, placing said crane pedestal on the base beams, releasably attaching the crane pedestal to the base beams, lifting a crane upper works from said transport vessel with said fixed crane, placing said crane upper works on said crane pedestal, and attaching the crane upper works to the crane pedestal.

* * * * *

UNITED STATES PATENT OFFICE

CERTIFICATE OF CORRECTION

Patent No. 4,081,932 Dated April 4, 1978

Inventor(s) James Eubank Armstrong

It is certified that error appears in the above-identified patent and that said Letters Patent are hereby corrected as shown below:

Column 1, line 17, that portion of the line reading "dock", should read -- deck --.

Column 1, line 31, that portion of the line reading "Fig", should read -- rig --.

Column 1, line 66, that portion of the line reading "platform.", should read -- platform, --.

Column 4, line 27, "a" should be deleted from the line.

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*